US006443659B1

(12) United States Patent
Patout

(10) Patent No.: US 6,443,659 B1
(45) Date of Patent: Sep. 3, 2002

(54) MOVABLE SELF-ELEVATING ARTIFICIAL WORK ISLAND WITH MODULAR HULL

(76) Inventor: Philip J. Patout, 221 Ramblewood Dr., Lafayette, LA (US) 70508

( * ) Notice: Subject to any disclaimer, the term of this patent is extended or adjusted under 35 U.S.C. 154(b) by 0 days.

(21) Appl. No.: 09/198,318

(22) Filed: Nov. 23, 1998

(51) Int. Cl.[7] ..... E02B 17/08; B63B 35/44

(52) U.S. Cl. ..... 405/196; 405/195.1; 405/203; 114/265

(58) Field of Search ..... 405/196, 197, 405/198, 199, 195.1, 203, 204; 114/77 R, 264, 265

(56) References Cited

U.S. PATENT DOCUMENTS 1,400,787 A * 12/1921 Baer ..... 114/77 R
3,044,269 A * 7/1962 Tourneau ..... 405/198
3,245,658 A * 4/1966 Sutton ..... 405/198
3,290,007 A * 12/1966 Yeilding ..... 405/198
3,433,024 A * 3/1969 Diamond et al. ..... 405/196
3,605,669 A * 9/1971 Yu ..... 405/204
3,732,840 A * 5/1973 Dane, Jr. ..... 114/77 R
3,805,721 A * 4/1974 Robishaw ..... 114/266
3,874,180 A * 4/1975 Sumner ..... 405/198
3,965,513 A * 6/1976 Horiuchi ..... 114/352
3,967,457 A * 7/1976 Lovie ..... 405/198
3,996,754 A * 12/1976 Lowery ..... 405/197
3,999,396 A * 12/1976 Evans ..... 405/203
4,056,943 A * 11/1977 Tarrant ..... 405/196
4,256,049 A * 3/1981 Brunet et al. ..... 114/77 R
4,276,847 A * 7/1981 Ivanov ..... 114/65 R
4,455,109 A * 6/1984 Lorenz ..... 405/203
4,668,127 A * 5/1987 Steele ..... 405/198
5,347,944 A * 9/1994 Dupre et al. ..... 114/77 R
5,833,397 A * 11/1998 Horton, III ..... 405/204

* cited by examiner

*Primary Examiner*—Gary S. Hartmann
(74) *Attorney, Agent, or Firm*—Jesse D. Lambert

(57) ABSTRACT

A buoyantly moveable, self-elevating (jack-up) artificial work island economically and quickly self-assembled while floating upon work body of water by reversibly coupling together a plurality of independently buoyant modular hull components each of which is of relatively narrow beam and therefore capable of navigation though relatively narrow water-ways. After self-assembly said artificial work island is self-elevating upon a plurality of legs a desired distance above said work body of water. The island may be buoyantly moved to subsequent work locations as a unit or separated into modular hull components each of which may be buoyantly moved separately to the subsequent locations. The island may have a drilling derrick, a hoist, drilling fluid pumps, a rotary table and other equipment associated with earthboring for oil and gas installed thereon.

14 Claims, 9 Drawing Sheets

MOVABLE SELF-ELEVATING ARTIFICIAL WORK ISLAND WITH MODULAR HULL

FIELD OF THE INVENTION

The invention disclosed and claimed herein relates generally to movable, self-assembling, self-elevating artificial structures designed to provide a stable, elevated work from which desired operations may be conducted over water. In certain fields such structures are referred to as "jack-up" rigs or platforms. With more particularity the invention disclosed and claimed herein relates to a platform composed of a plurality of independently buoyant, modular hull components each of which is navigable through waterways of limited width, depth and/or overhead clearance; each of which is capable of being facilely coupled together with other hull components at desired work locations to form a larger self-elevating work platform; which said platform may be subsequently, either as an integral unit or by disassembly of the modular hull components, buoyantly navigated to subsequent work locations.

DESCRIPTION OF RELATED ART

Particularly In the field of oil and gas exploration "jack-up" structures of various designs are well known. Though such structures have utility beyond mineral exploration (such as facilities for navigational beacons, weather stations, offshore mooring facilities, and as work platforms from which over and underwater construction and/or repairs may be conducted) they are most frequently used for earth boring, and production of fluid minerals from earth bores, located below water of "medium" depth. By water of "medium" depth it should be understood that submersible barges are usually used in very shallow (approximately less than 15 feet) water, "posted barges" in waters of slightly greater depth (approximately less tat 25 feet) and various floatable or permanent structures used in deep (approximately over 250 feet) water.

Thus, it Is in waters of medium depth that jack-up structures find their greatest utility. Prior art teaches that such structures consist of a single buoyant hull, a plurality (usually three) of legs, jacking mechanisms that can raise or lower the legs as required and equipment designed to support the operations to be conducted at the work location. Such structures are typically buoyantly navigated on water, typically by tow, to a work location, after which the legs are lowered to the bottom, followed by continued jacking until the hull is a suitable distance (usually called an "air gap") above the surface of the water. Typically from such elevated position desired operations are conducted, and when complete, the jack-up can be re-mobilized by jacking-down until the hull is re-floated, the legs lifted from the bottom and the unit navigated on water, typically by towing, to subsequent work locations.

However, beyond the depth limitations suggested above, prior art jack-ups have other limitations. If small, the distance between the legs supporting the platform is small, and such platform cannot be safely used (are unstable and likely to topple over) in deep water. If on the other hand the platform Is large (and therefore the legs can be sufficiently spaced apart to support operations over deeper water) such platform is of substantial beam and thus cannot be moved through narrow waterways to certain bodies of water.

By way of example, one body of water which is more than sufficient size to accommodate large jack-ups, and where such structures are greatly needed for exploration and/or production of oil and gas, is the Caspian Sea. However such structures cannot be navigated to the Caspian Sea at the present time due to the narrow width, height and draft limitations of waterways leading thereto. Neither are the shipyard facilities located on the Caspian Sea adequate for construction of a such structures thereon. Even if such structures were constructed on the Caspian Sea, they could not be quickly or economically moved out of the Caspian Sea through presently existing water ways If that should become necessary.

Accordingly, and the Caspian Sea is but one example, there is a great need for a jack-up structure of substantial size (that is the horizontal distance between supporting legs is substantial, thereby supporting a jack-up which is safe in water of substantial depth) which can be brought to a work body of water through relatively narrow waterways leading thereto. Without limitation (because the invention disclosed and claimed herein can also be used in almost any environment where currently existing Jack-ups are used) the present invention is directed towards provision of a self-elevating tack-up) work platform of substantial size which is comprised of a plurality modular buoyant components designed to be navigated through waterways of limited width, height and/or draft, and is facilely self-assembling on a work body of water.

SUMMARY OF THE INVENTION

The present invention is directed to a movable, self-elevating jack-up), artificial work island composed of a plurality of relatively narrow, independently buoyant, modular and self-assembling hull components, each of which said hull components is capable of independent navigation through relatively narrow waterways and thereafter being facilely coupled together at a work location to form a larger, self-elevating, work platform. Said invention is primarily characterized by being composed of a plurality of modular hull components which are designed to be coupled together at a work location to form a larger self-elevating work island. Each modular hull component Is Independently buoyant and Is therefore capable of navigating, typically under tow, as a separate vessel. Said hull components are of narrow beam so that they may be buoyantly navigated through narrow waterways. Said hull components are preferably elongated (having a length In excess of their narrow beam) so as to minimize the number of hull components required to form a work platform of desired size and maximize the distance between the legs supporting the assembled work platform. They may also be of relatively low height and of shallow draft where overhead clearances and depth of the narrow waterways is also limited.

When reaching a work location the modular hull components are designed to be self-assembling (facilely coupled together on a work body of water) to form a work platform having a substantially larger beam than the Individual hull components. After assembly, typical leg means and jacking means are employed to elevate and lower the assembled work Island as desired. The assembled work platform is itself buoyant and may be moved to subsequent work locations over waters sufficient to accommodate the beams of the assembled work platform. Coupling of the Individual hull components together may be facilely reversible or substantially permanent. Whatever means of assembly is employed, the modular hull components of the work platform may be facilely and economically de-coupled, on the work body of water, and subsequently navigated as independent modules through either narrow waterways or over open water.

OBJECTS OF THE INVENTION

The principal object of the present Invention is to provide an improved mobile, self-elevating work island. More particularly an object of the Invention is to provide a mobile, self-elevating work island composed of a plurality of assembled modular hull components each of which is of narrow beam, is independently buoyant, and is therefore capable of being independently navigated, as a vessel, typically by tow, through relatively narrow waterways. Another object of the invention is to provide a plurality of independently buoyant modular hull components which are capable of being interconnected with other hull components to form a work platform which is larger than said modular hull components. Yet another object of the invention is to provide an assembled self-elevating work platform which is Itself capable of being buoyantly navigated as an integral unit, typically by tow, over waters of sufficient width to accommodate the beam of the assembled work platform.

A platform composed of narrow hull components is, while disassembled, capable of being navigated through narrow waterways, which forms another object of the invention. An artificial work island composed of such hull components may also be, while disassembled, more facilely navigated over open water than a typical platform (of substantial beam and roughly equal length); therefore yet another object of the invention is to provide for such work island.

PREFERRED EMBODIMENT OF THE PRESENT INVENTION

While the present invention will herein be described with reference to preferred embodiments thereof, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present Invention not be limited to the particular embodiments disclosed, but that the Invention will include all embodiments (and legal equivalents thereof) falling within the scope of the appended claims.

In particular it should be understood that although the preferred embodiment of the present invention primarily concerns itself with a self-elevating work island which is fitted with a derrick, crane and other components typically used in offshore earthboring operations adaptation, the invention is not limited to such adaptation, and may be adapted to many other over-water operations, including but not limited to, a platform for navigational beacons, meteorological stations, offshore mooring and/or unloading or loading facilities, work platforms from offshore construction and/or diving operations may be conducted and other operations where a movable work island may be useful.

Figure 1:
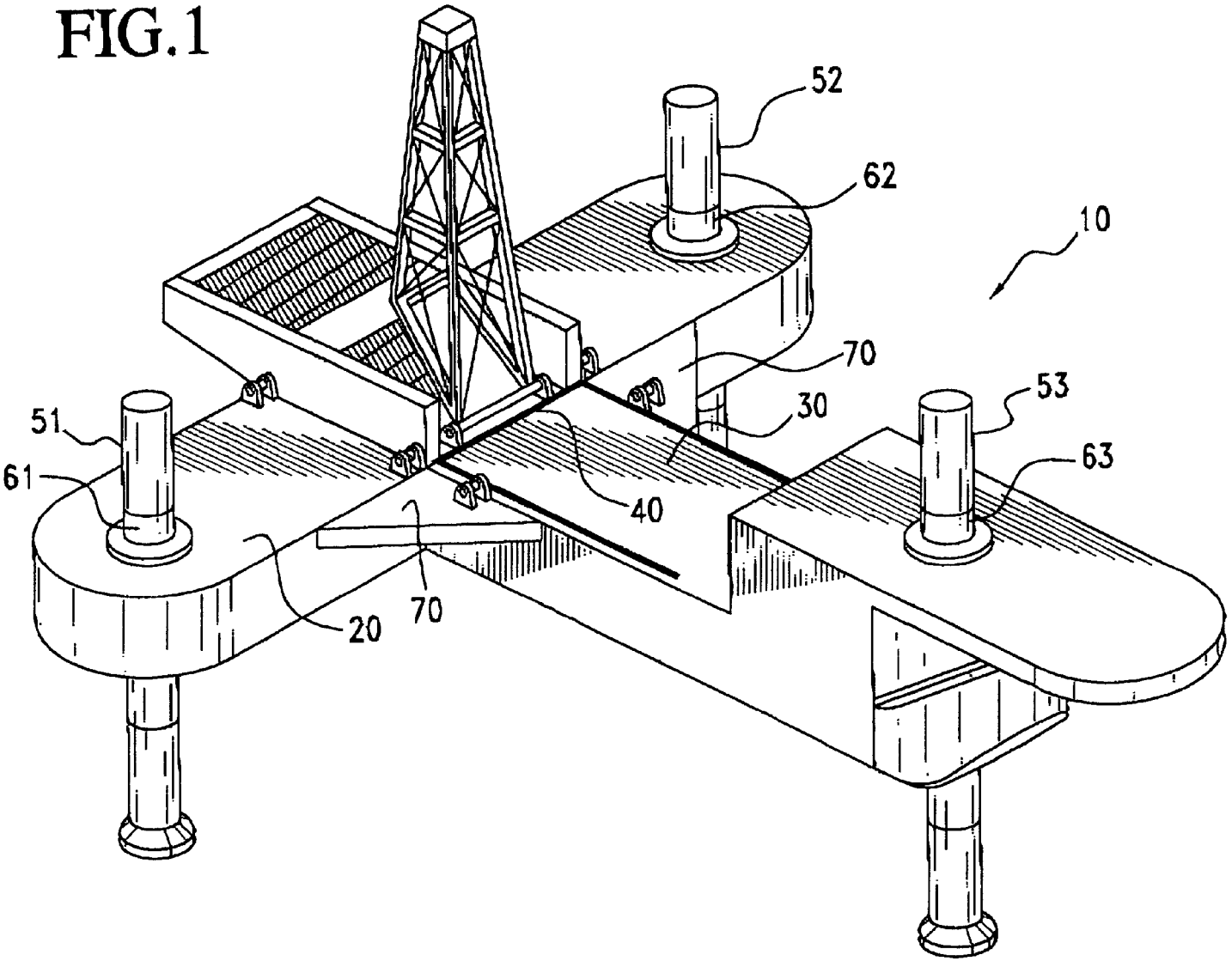
FIG. 1 is an isometric perspective of the principal components of the preferred embodiment of the present invention.
Figure 2:
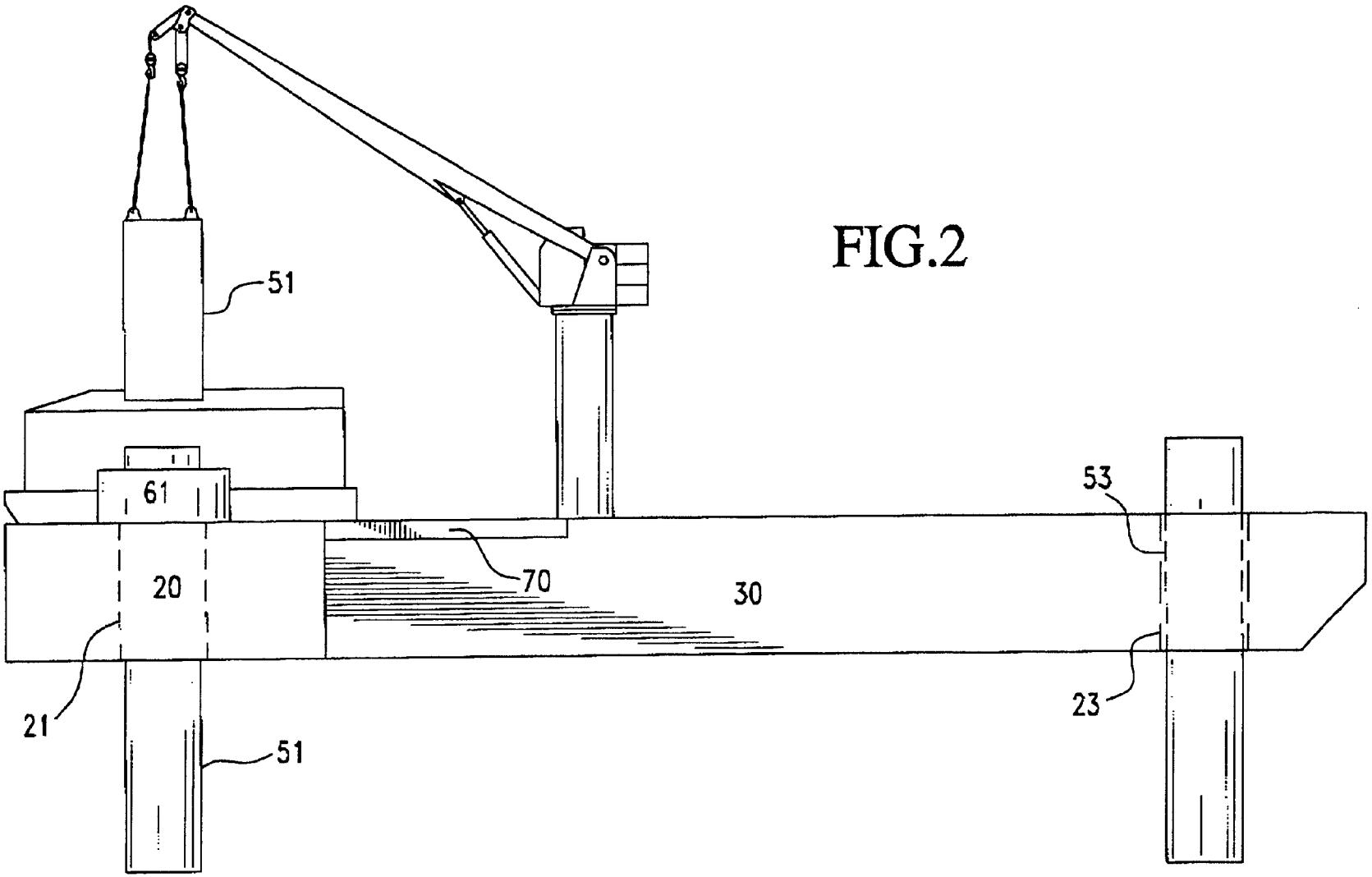
FIG. 2 is a side view of the preferred embodiment of the present invention showing an extension being added to one leg thereof.

FIG. 1 illustrates a preferred embodiment of the assembled self-elevating work platform of the present Invention. Said work platform, 10, is principally characterized of a plurality (at least two) of independently buoyant modular hull components, 20 and 30, which are (when assembled) coupled together at joint 40. Said platform is also characterized by plurality (at least three) legs, 51, 52, and 53. Jacks 61, 62, and 63 may be used to move said legs, 51, 52, and 53, upwardly and downwardly in relation to work platform, 10. FIG. 2 depicts a side view of the preferred embodiment of the assembled invention.

Figure 3:
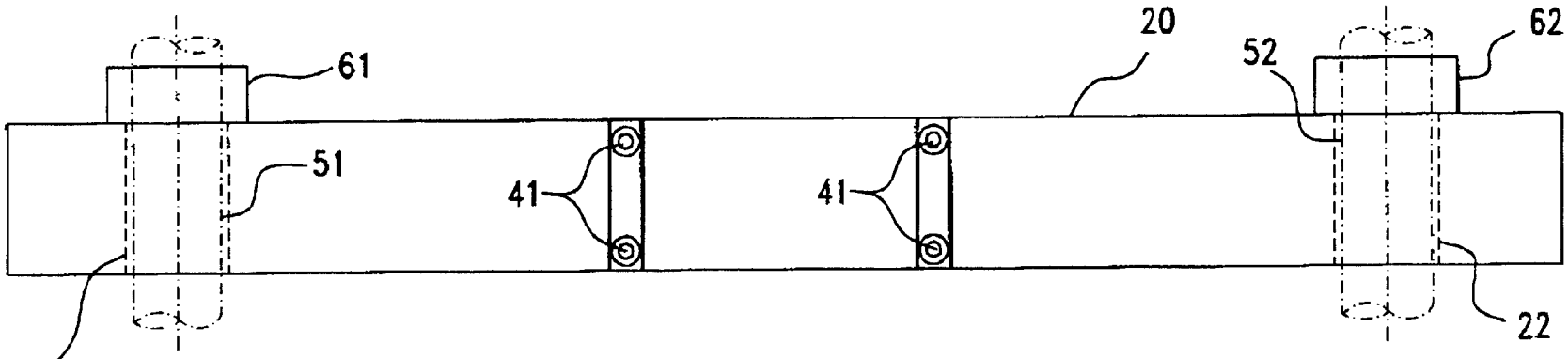
FIG. 3 is a side view of the first hull component of the preferred embodiment of the present invention.
Figure 4:
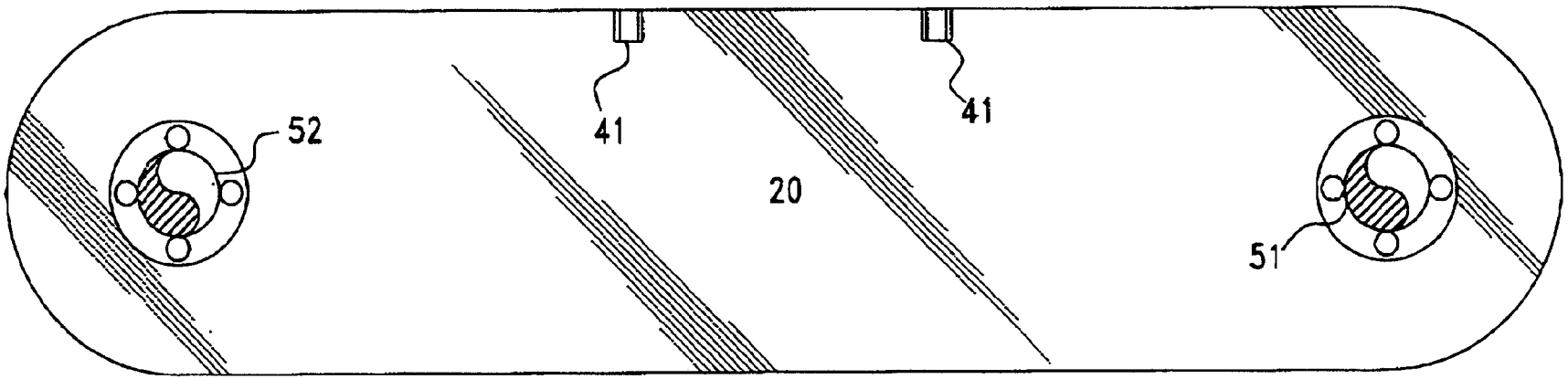
FIG. 4 is an overhead view of the first hull component of the preferred embodiment of the present invention.

Illustrated in FIG. 3 is a side view of a preferred embodiment of hull component 20. FIG. 4 is an overhead side view of the same hull component 20. Modular hull component 20 is designed from the onset to be independently buoyant and therefore capable of independent navigation as a vessel, typically by towing, over navigable waters of sufficient depth to accommodate its draft. In a preferred embodiment of the invention which is directed to assembly of a three legged work platform suitable for oil and gas drilling operations, hull component 20 will typically be constructed of a beam framework (typically of metal beams) covered with sheet metal (also typically metal). In the preferred embodiment of the invention hull component 20 will have a beam at least slightly less than the narrowest point on the narrowest waterway which it is expected to traverse to reach the locations where the work platform, when assembled, will be expected to work. In said preferred embodiment hull component 20 is equipped with two water-tight, sleeved hull penetrations, 21 and 22, disposed proximate the ends of hull component 20, through which two of the legs of the platform, 51 and 52, are slidably disposed. Hull component 20 is also equipped with jacks 61 and 62 which move legs 51 and 52 upwardly and downwardly as desired.

In the preferred embodiment of the invention, hull component 20 is also equipped with means for facilely and reversibly coupling hull component 20 to hull component, 30. As depicted in FIGS. 3 and 4 such means are comprised of four female, 41, receptacles of a breech-lock type coupling mechanism. However, various other means for coupling hull components 20 and 30 may also be employed. Alternatively each hull component might be coupled together by clevis and pin arrangements or by cantilevering a portion of one hull component over the other and pinning them In place. In practice and as a safety measure, it will generally be desirable to employ more than one means of coupling the hull components together, one means constituting a back-up In case the other falls. Alternatively hull components 20 and 30 may be joined by welding them together on the work body of water. Whatever coupling means is used should be very strongly attached to load bearing structural members of both hull components, so as to provide a strong, rigid means of interconnection of hull components.

Figure 5:
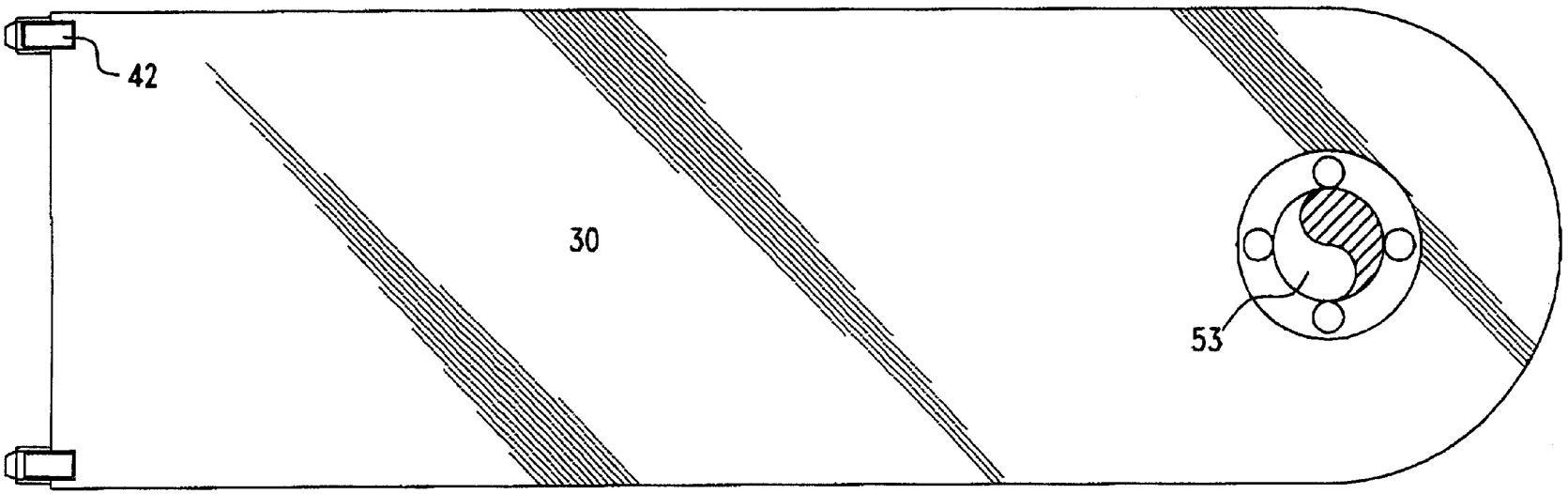
FIG. 5 is an overhead view of the second hull component of the preferred embodiment of the present Invention.
Figure 6:
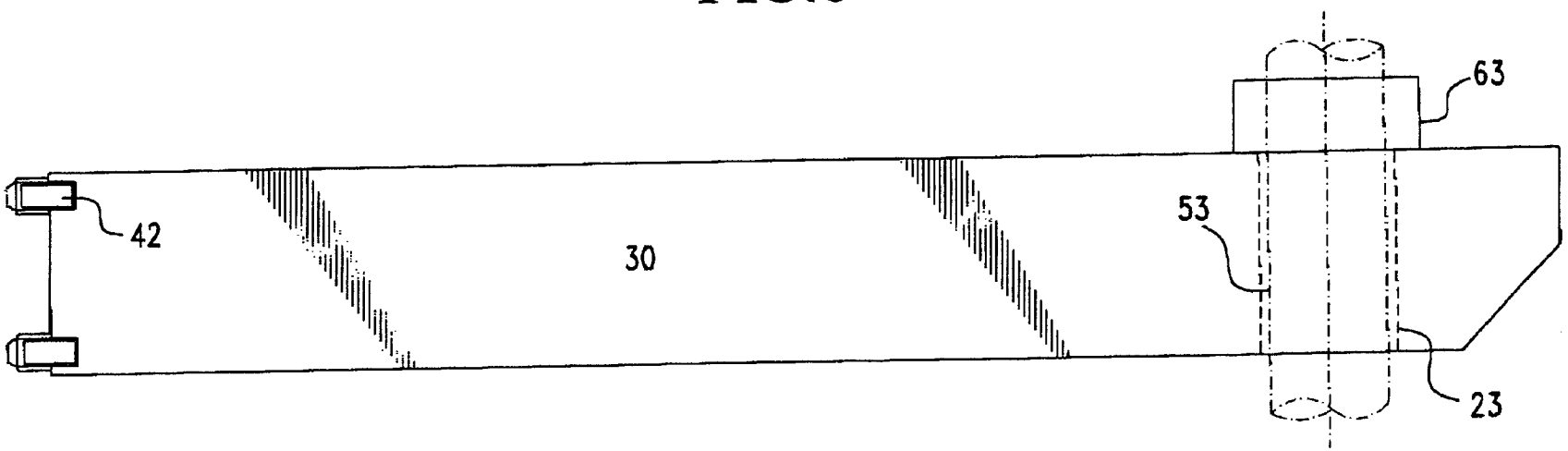
FIG. 6 is side view of the second hull component of the preferred embodiment of the present invention.

Now referring particularly to FIGS. 5 and 6, second hull component 30 is also preferably of metal frame and sheet metal construction. As is the case with hull component 20, hull component 30 is designed from the onset to be independently buoyant thus capable of independent navigation, as a vessel, over navigable waters sufficiently large and deep to accommodate it Accordingly It will also have a beam at least slightly less than the narrowest point on the narrowest waterway which It must traverse enroute to desired work locations.

As further depicted in FIGS. 5 and 6 one end of hull component 30 has couplings, 42, designed to mate with the couplings disposed on hull component 20, so that, in the preferred embodiment the end of hull component 30 may be coupled perpendicularly to the side of hull component 20. As depicted in FIGS. 5 and 6, In the preferred embodiment couplings 42 are comprised of four male projections of a breech-lock type connector which mate with the four female receptacles of hull component 20. After mating of the breech lock connectors locking pins, 43, would typically be inserted, as shown, to secure said connection. Alternative couplings may be used on hull component 30 so long as they are designed and disposed so as to strongly mate with hull component 20 when hull components 20 and 30 are in desired position.

Hull component 30 also has a water-tight, sleeved hull penetration 23 disposed proximate to the end of hull component 30 which is opposite couplings 42. Accordingly when hull components 20 and 30 are perpendicularly interconnected, as shown in FIG. 1, the platform, comprising a plurality of interconnected hull components, is supported by three legs, 51, 52 and 53 which are widely separated horizontally. So disposed the platform is stable in relatively deep water. Jack 63 is employed to move leg 53 upwardly and downwardly as desired.

If necessary, flashings 70 may be employed to increase lateral load bearing capability of the work platform and/or increase available deck space. Flashings 70 are removable and would typically be removed during navigation of the hull components through narrow waterways.

Before being dispatched to a work location hull component 20 will typically be equipped with various appurtenances directed towards the accomplishing the desired work once the modular hull components are navigated to the work body of water, self-assembled on and self-elevated above said work body. For instance in the case of a work platform which is intended to accomplish drilling for oil and gas each of the modular hull components would have various appurtenances directed to accomplish such operations installed thereon. For instance, in the preferred embodiment of the invention as a derrick, hoisting equipment, rotary turntable and pumps, lines and tanks for handling drilling fluids would typically be installed on one or the other of said modular hull components. Likewise living quarters, a crane and a helipad may be installed on one or the other of said modular hull components.

By utilization of appurtenances having certain design characteristics height of each modular hull component and equipment thereon can be controlled to allow passage of each of said modular hull components through waterways which not only have a narrow width, but have height and draft restrictions. For instance a derrick of "lay down" design will be typically used. Likewise, to accommodate height restrictions, it is possible that only a partial length of the legs will be installed before transit to the work body of water. Additional sections will usually be added after coupling of the modular hull components on the work body of water and elevating it at least slightly in order to stabilize the platform.

Similarly projections below the modular hull components will typically be avoided prior to arrival on the work body of water so as to limit the draft of said modular hull components. Therefore the legs of the work platform will typically be retracted so as to be flush with the bottom of said modular hull components during transit.

Accordingly due to the modular nature of the components of the work platform of the present invention, it will be possible to bring a relatively large size work platform to a work body of water through waterways leading thereto which may be limited in width, height and depth.

It will also be advantageous to "modularize" various utilities or services which may be necessary for each of the modular hull components to have. For instance, on a rig which is used in drilling for oil and gas It is likely that both of the modular hull components will need a supply of electricity, potable water, non-potable water, hydraulic pressure, air pressure and possibly drilling fluid lines. Yet it would not be economical to provide each module with an independent source of each of these utilities or services. In such case it is preferred that there would be only one supply for each of these services or utilities, but lines for connecting such utilities to the other hull component be provided at or near the area the hull components are designed to mechanically Interconnect. In this fashion It will be relatively facile to provide the entire platform with common sources for said utilities and services.

As will be obvious to those skilled in the art, more than two hull components may be coupled together if necessary to provide a work platform of a desired size, and said hull components need not necessarily be coupled together in perpendicular relationship, but may be coupled side to side or even at various angles if necessary. Those skilled in the art will also recognize that while the invention disclosed herein comprehends a minimum of three legs which will support the assembled platform, if necessary more than three legs may be employed and disposed at proper position in whichever hull component may be appropriate.

The preferred method of constructing the components of the present invention is initiated with pre-installing equipment onto hull components 20 and 30 at a shoreside facility.

Figure 7:
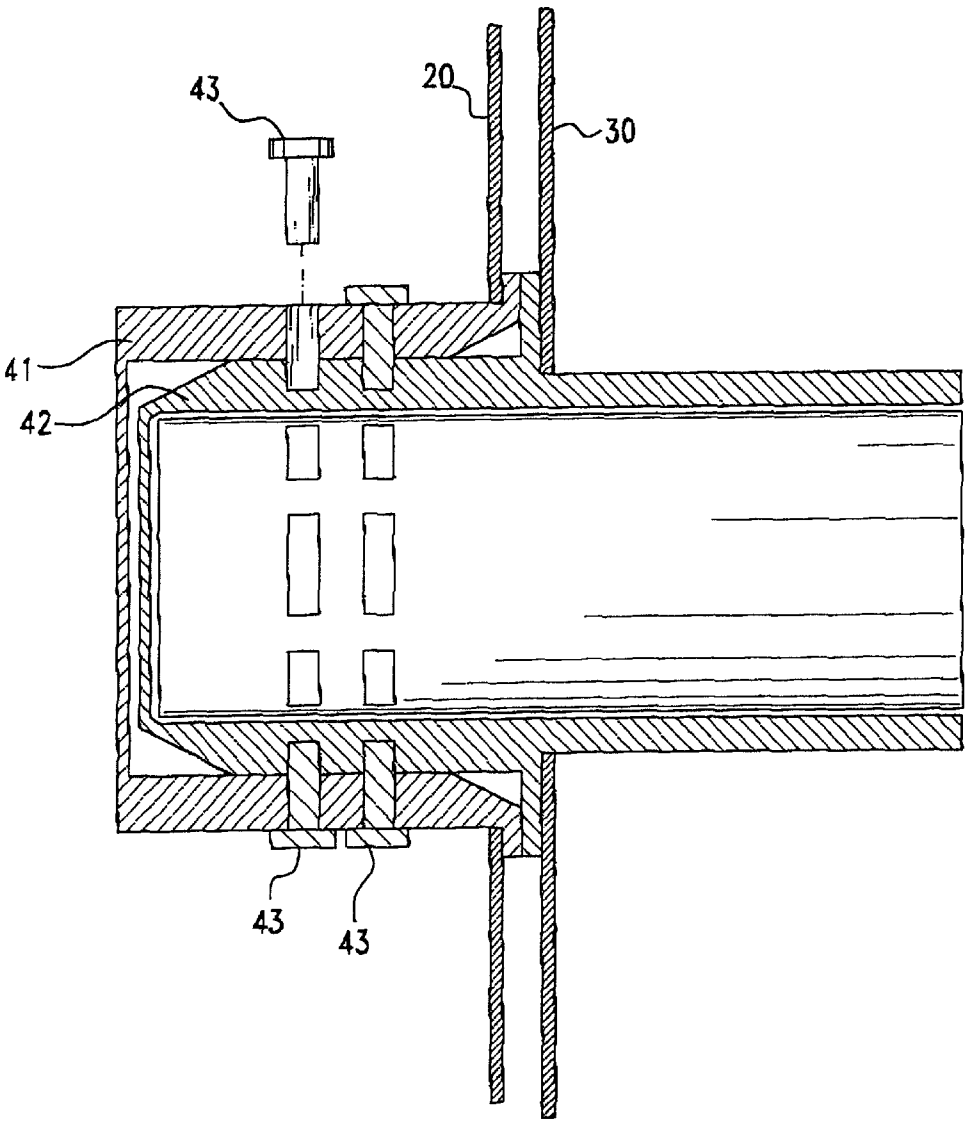
FIG. 7 is a detail overhead view of the preferred coupling components of the preferred embodiment of the present invention.
Figure 8:
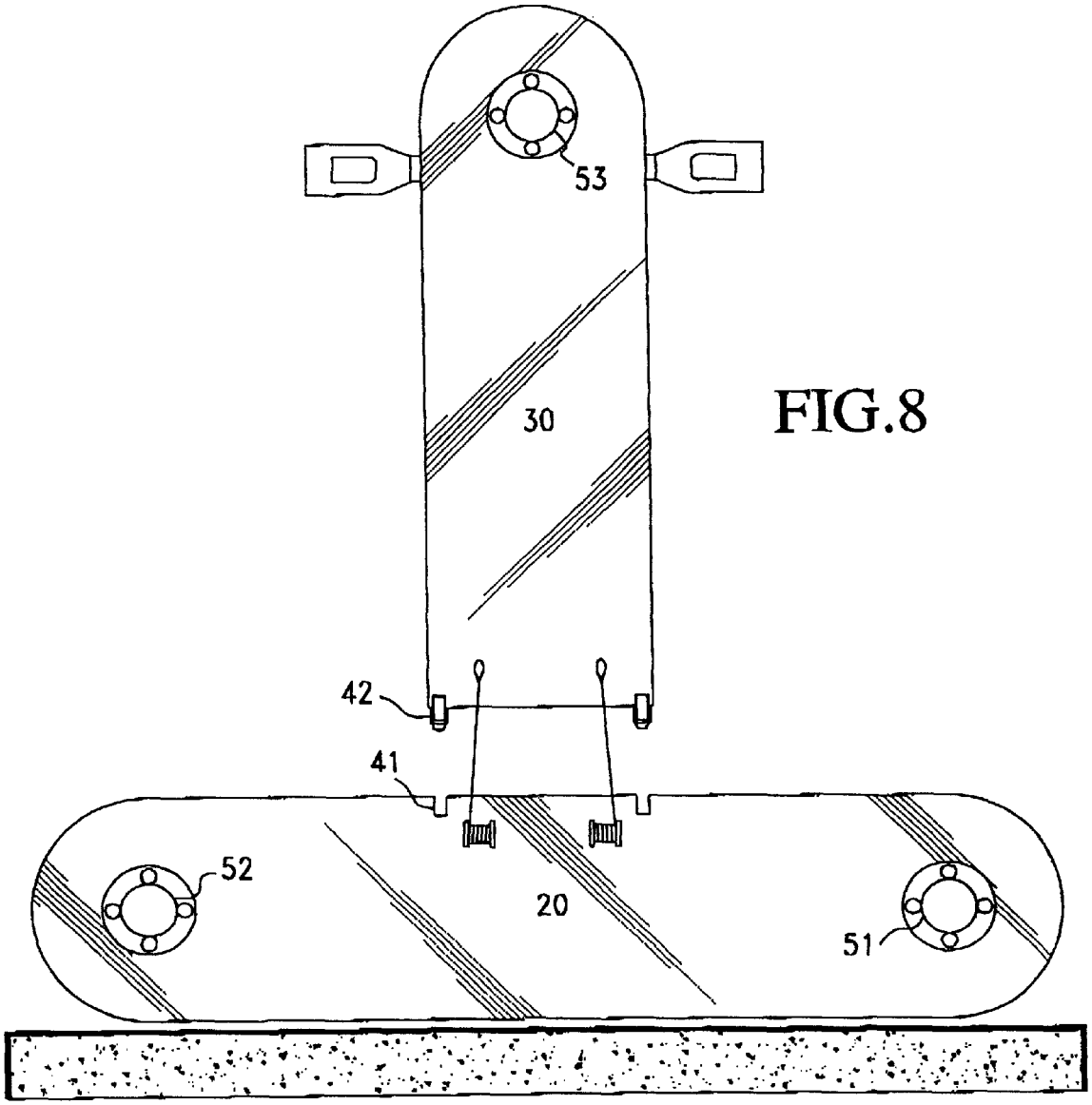
FIG. 8 is an overhead view of two hull components of the preferred embodiment of present invention being drawn together by cable winches.
Figure 9:
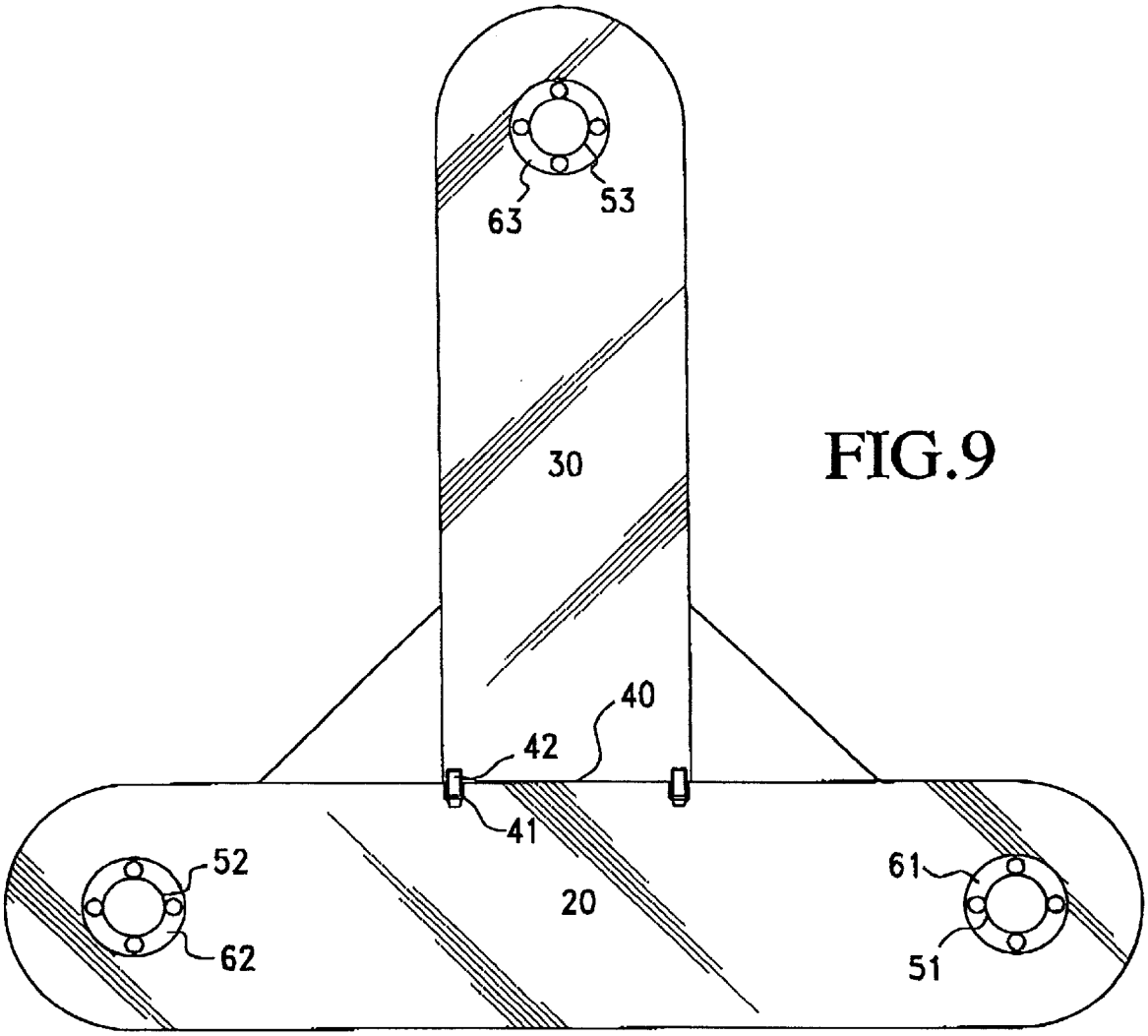
FIG. 9 is an overhead view of the two hull components of the preferred embodiment of the present invention in proximate relation to each other.

Thereafter, both hull components 20 and 30, along with at least a portion of legs 51, 52 and 53 in place and retracted are independently transported to a first work site. Upon reaching said work site, hull components 20 and 30 are positioned so that couplings 41 and 42 can be interlocked, as shown in FIGS. 7 through 9. In the preferred embodiment, cable winches and hydraulic jacks are used to tightly draw couplings 41 and 42 together. After being drawn tightly together 41 and 42 will be locked together by pins 43. After hull components 20 and 30 are interconnected and now form a unitary work platform 10, jacks 61, 62 and 63 are respectively used to lower legs 51, 52 and 53 until they rest on the marine floor. If necessary additional length can be added to the legs at this time, typically by welding to the upper ends thereof. Jacks 61, 62 and 63 are then typically operated further (lacking said legs down) until the work platform is elevated a desired distance, usually called an "air gap" above the surface of the water. Typically after said air gap is established, the work the platform was designed to accomplish at the work location, for instance drilling operations, is commenced.

Once operations are completed at the first work site, mobile, self-elevating work island 10 can be remobilized by substantially reversing the above described procedure. Work platform 10 is jacked down to the marine surface until buoyancy of the work platform is reestablished. Further jacking upward thereafter, possibly in conjunction with conventional jetting of the leg bottoms, elevates the legs from the marine floor and permits the work platform to be moved as a unitary structure to subsequent work locations. Alternatively, if desired, hull components 20 and 30 may be de-coupled and independently moved to subsequent locations, If necessary through waterways of limited width, depth or having obstructions which limited the height of vessels passing therethrough.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

I claim:

1. A movable self-elevating work island, comprising:

(a) a pair of buoyant hull components each of which:

i) is capable of independent buoyant navigation over water;

ii) has an elongated rectangular shape when viewed from above; and iii) has at least one leg slidably attached thereto, #at least one of said hull components has at least 2 legs slidably attached thereto at all times, said 2 legs disposed in a spaced apart relationship and substantially at either end of said hull, wherein until said pair of hulls are joined together, each of said hulls retains said elongated rectangular shape without substantial side protuberances;

(b) a plurality of non-welded couplings disposed between said pair of buoyant hull components when said buoyant hull components are in a desired proximate relationship, for coupling said buoyant hull components together to form a buoyant unitary work island; and (c) a plurality of jacks attached to said unitary work island and to each of said legs for raising and lowering said legs to the bed of a body of water upon which the unitary work island is buoyantly disposed and for elevating and lowering said unitary work island a desired distance above the surface of said body of water.

2. The movable self-elevating work island of claim 1, wherein:

a) each of said pair of buoyant hull components are elongated with a length-to-beam ratio from two to eight; and b) said pair of buoyant hull components are adapted to be joined together with said plurality of couplings so as to form a "T" shaped structure when viewed from above.

3. The movable self-elevating work island of claim 2, wherein a maximum width of said first and second buoyant hull components is less than sixty feet.

4. The movable self-elevating work island of claim 2, further comprising at least one flashing adapted to be removably mounted at a junction between said plurality of buoyant hull components, thereby providing increased deck space for said work island.

5. The movable self-elevating work island of claim 1, further comprising at least one flashing adapted to be removably mounted at a junction between said plurality of buoyant hull components, thereby providing increased deck space for said work island.

6. The moveable self-elevating work island of claim 1, wherein said buoyant hull components are comprised of a metal framework having a covering of water-tight metal sheeting, which said metal framework includes a plurality of load bearing metal beams.

7. The moveable self-elevating work island of claim 1, wherein each of said plurality of couplings are strongly attached to said load bearing metal beams.

8. The movable self-elevating work island of claim 7, further comprising a derrick, a hoist, drilling fluid pumps and a rotary table.

9. The movable self-elevating work island of claim 1, wherein each of said plurality of buoyant hull components has a length-to-beam ratio from two to eight.

10. The movable self-elevating work island of claim 9, further comprising a derrick, a hoist, drilling fluid pumps and a rotary table.

11. The movable self-elevating work island of claim 1, wherein said plurality of couplings comprises projecting male members adapted to be received within mating female receptacles, and wherein locking pins are inserted through said male members and said female receptacles when said male members are disposed within said female receptacles, thereby permitting said plurality of buoyant hull components to be connected and disconnected at any desired location.

12. The movable self-elevating work island of claim 1, wherein each of said legs is disposed through a water-tight sleeve penetrating one of said buoyant hull components.

13. The movable self-elevating work island of claim 12, further comprising a derrick, a hoist, drilling fluid pumps and a rotary table.

14. The movable self-elevating work island of claim 1, further comprising a derrick, a hoist, drilling fluid pumps and a rotary table.

* * * * *